United States Patent [19]

Nicholson

[11] 4,281,865

[45] Aug. 4, 1981

[54] INTERIOR DOOR SECURITY

[76] Inventor: James A. Nicholson, 10600 Van Stralen Way, Rancho Cordova, Calif. 95670

[21] Appl. No.: 94,973

[22] Filed: Nov. 16, 1979

[51] Int. Cl.[3] ..... E05C 19/18

[52] U.S. Cl. ..... 292/258; 292/246

[58] Field of Search ..... 292/258, 288, 246, DIG. 2

[56] References Cited

U.S. PATENT DOCUMENTS

| | | | |
|---|---|---|---|
| 765,658 | 7/1904 | Beseler | 292/258 |
| 827,624 | 7/1906 | Foster | 292/288 |
| 3,451,708 | 6/1969 | Brooks | 292/264 |

*Primary Examiner*—Richard E. Moore

[57] ABSTRACT

An interior door knob security cinch loop comprising, a rectangular shaped plate bent at appointed and spaced apart relationship to form a vertical back with a top and base horizontal extensions wherein, said top has a triangularly shaped eyelet extending upward from said top and open vertically of said horizontal top. The base extension extends beyond said top extension slightly and has its forward edge diagonally planed inward to form a chisel edge and the inner said base has a predetermined number of inwardly punched out, triangularly shaped, grip points facing the vertical back of said plate. A wire of high tensile strength is threaded through the aforesaid eyelet and the ends of said wire are secured together to form an extended loop. A metal plate formed in the shape of a vertical rectangle which is inwardly open and having a retainer shaft extending from said rectangular side horizontally to house an anchor hook and/or a combination anchor device which uses a circular elastic loop. A dual door knob anchor loop, dual anchor hooks and/or dual combination anchor devices and dual elastic loops.

3 Claims, 4 Drawing Figures

INTERIOR DOOR SECURITY

BACKGROUND

Most interior door chain and guard devices concentrate on attachment of said devices to the interior trim face and the leading edge of doors which is understandable and satisfactory for the law abiding person however, to a felon the above mode enhances his chances of forced entry once, the primary locking system is released for inquiry, i.e., 1. The occupant has a false sense of security with the above mode.

2. Doors, in most cases, are made of inner frames which are normally covered with composition board therefore, the attachment must penatrate the frame to be effective and a miss of said frame is no security for the occupant who normally installs the device.

3. The chain devices allow the door to be opened wider which allows forced leverage and to enhance this leverage most such chain devices are installed at shoulder height and the forced leverage is further enhanced by the fact that the trim and door attachment are in close alignment thereby, force makes the chain pull the screws practically streight out of the trim also, said screws thread is so closely knit that said threads act like a coring device therefore, only the tip of the screw really has grip or hold which is to the benefit of the felon, finally, the placement of said devices at the edge of trim and doors makes the aforesaid more susceptible to splintering.

SUMMARY OF INVENTION

The interior door knob security cinch loop takes advantage of the disadvantages outlined in the background above and also, provides more advantages, i.e., 1. No screws are used for installation therefore, the wood grain is not damaged or weakened therefrom such use.

2. Forcing leverage of the door is equalized when achoring is achieved in alignment with the door knobs base and strengthened since the steel inner bar takes the pressure of forced entry.

3. The strength of the eight to fourteen nails and the strength of the trim is used since, the anchor of said invention is installed under said trim.

4. The security cinch loop will reduce the opening of the door when the primary locking system is released and thereby reduce leverage.

5. Cinch looping of dual door knobs take advantage of the primary locking systems knob attaching steel bars.

6. Also, the trim can be reinforced if so desired by the occupant.

7. Occupants sense of security is enhanced and greater security is provided from forced entry.

VIEWS OF INVENTION

FIG. 1. This is the embodiment of the interior single door knob security cinch loop.

FIG. 2. Here several modes of joining the primary security loop ends together.

FIG. 3. Is a side view of the loop cinch plate which is phantomed in the cinches operative mode also, two modes of securing the cinch.

FIG. 4. This is an embodiment of the security cinch loop used on dual door knobs.

DETAILED DESCRIPTION

Figure 1:
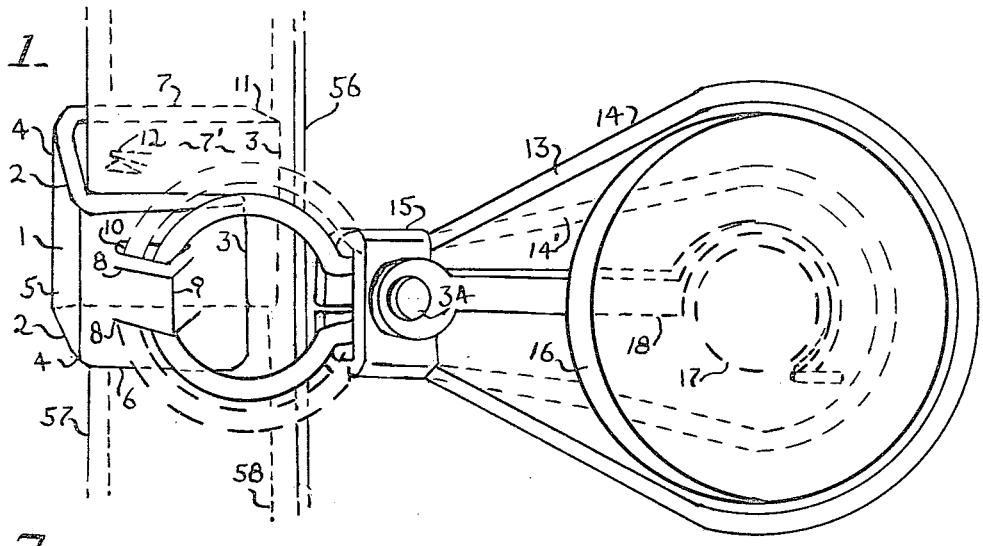

The interior door knob security cinch loop can be manufactured by using the stamp press mode of construction using firm metal sheeting for the anchor plate and loop cinch also, the anchor hook and the combination anchor device. The primary loop is made of high tensile wire, to include braided wire of the same strength also, the second loop can be made of durable elastic material in the form of a single band. In all, this innovative security mode is a departure from conventional door security methods. FIG. 1. The interior single door knob security cinch loop is comprised of a door trim anchor plate 1 wherein, two horizontal parallel lines 2 are spaced apart horizontally with the aforesaid parallel lines vertically closed 3 to create a firm and strong rectangular shaped plate, in the anchor's original form, herewith, the plate is bent at two points 4 inwardly, by the press method, to form a vertical back 5, a top 6 and a base horizontal 7 extension, in the basic shape of a "C", hereat, the top 6 extension, near its vertical back 5, is stamp press cut horizontally of said top in two spaced apart parallel lines 8 and the strip between said lines is stamp punched 9 upwardly, from said top, to form a triangularly shaped eyelet 10 which is open vertically of the horizontally situated top 6 extension. The base 7 extension, of the trim anchor plate 1, at its forward edge is planed diagonally outward of said edge to form a chisel edge 11 which will enhance engagement of said anchor plate under door-way trim and to insure retainment of said plate in its aligned position the base 7 extension has inwardly 7' of said base, a predetermined number of punched-out inwardly and triangularly shaped grip points 12 which face rearward of said chiseled edge thereat, the grip points, when the anchor plate 1 is forced rearward, will dig into the door-way trim thereby, making it very difficult to dislodge said anchor plate. A horizontally extended wire, of high tensile strength, to include braided wire, is laced through the aforesaid top 6 extension's open eyelet 10 and both ends of said wire are anchored together in one of the selected modes of figure two herewith, a circular primary loop 14 is formed and it is this primary loop which is threaded through the loop cinch 15 and slipped over the door knob 16, in close proximity of said knob, thereat, the cinch loop 15 is drawn toward the said knob and simultaneously tightening the primary loop 14 around said knob as indicated by the phantomed loop 14' in the illustration. It is to be noted that the closer the loop cinch 15 is to the door knob shank 17 the smaller the primary loop 14 will be at said shank thereby, enhancing the secureness of said loop. With the loop cinch 15 forward, the attached cinch anchor hook 18 is secured around and slightly behind the shank 17 of the door knob 16 herewith, the interior door knob security cinch loop is in its operable mode for a single door knob.

Figure 2:
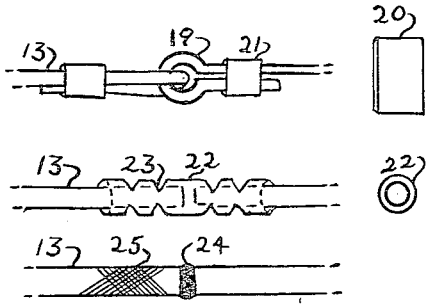

FIG. 2. Here, there are several modes of securing the ends of the aforesaid horizontally extended wire 13, to include braided wire and, the first method is joined loops 19 which are secured equally at each end by a firm metal 20 plate having two parallel horizontal line, spached apart and vertically closed at each end of said parallel lines to form a rectangular shape of said plate which is stamp pressed circularly 21 around the entwined joined loops 19 of said wire 13 thereat, forming a circular primary loop 14. Also, a second method using a circular elongated inwardly open tube 22, much like electrical connections wherein, a firm and strong metal tube encase the two ends of the primary loop 14 and said tube is stamp pressed with a crease 23 at several points of said tube therein, securing and forming said loop. Again, a third securing method where said loop ends are spot welded 24 to secure and form the aforesaid primary loop 14. As indicated previously, braided wire 25 can be used to fabricate said loop. All of the aforesaid wire should be of high tensile strength which would forstall and aid in the prevention of forced entry.

Figure 3:
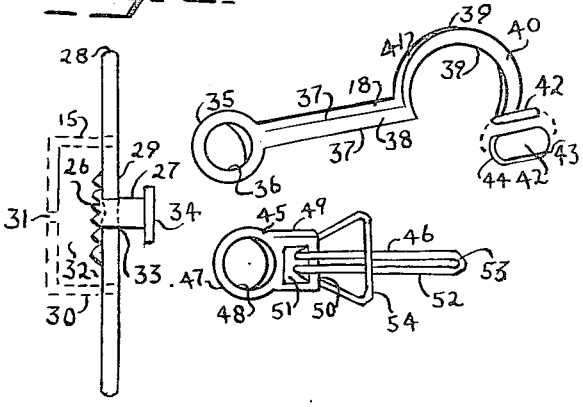

FIG. 3. Here the loop cinch 15 is shown in a side view to illustrate the stamp press bradded base 26 of the cinch shaft 27 however, the original cinch plate 28 consist of two horizontally extended parallel, spaced apart and vertically closed at end of said parallel lines to form a strong rectangular shaped metal plate wherein, the said cinch plate 28 is bent inwardly from both ends to form a vertical flat top 29 and having an upper and lower outward horizontal extensions 30 from said top, the said extensions are again, equally, bent downward and upward to form two opposing ends 31 thereat, forming the basic loop cinch 15 rectangularly shaped and open 32 through its center. The aforesaid loop cinch should be capable of with-standing stress since, force on a door will tend to make each side of the primary loop separate outwardly when force is applied. The vertical flat top 29 has centrally of said top, a circular aperture 33 therein, which houses a solid circularly shaped cinch shaft 27 that extends horizontally outward from its bradded base 26 attached to the aforesaid vertical top 29 of the loop cinch 15. Also, to retain the cinch anchor hook 18, to the aforesaid shaft, a circular shaped retainer 34 is constructed simultaneously with the solid circular cinch shaft 27 whereat, the retainer extends circularly beyond the solid circular cinch shaft 27 thereby, forming a retainer for the said anchor hook. The cinch anchor hook 18 is constructed to secure and maintain said hook in close proximity with said knob shank 17 and thereby maintaing the loop cinch 15 as close to the door knob 16 as possible to keep the end of said loop as small as possible at said shank this, will prevent loop slip over and off said knob. The said hook consist of a rearward semi-circular shaped outer ring 35 which is inwardly spaced apart by an inner circular aperture 36 which will be used to house the solid circular cinch shaft 27 and connected and extending horizontally outward from said semi-ends of ring 35 are two extended horizontal parallel lines 37, spaced apart to form a rectangular shaped flat vertical bar 38 and extending upward from said parallel lines 37 and connected are two extended semi-circular parallel lines 39 to form the shape of a flat semi-circular hook 40 inwardly open 41 whereby the hook end extends downwardly beyond the axis of the said door knob shank 17, in this manner, the hook 40 will not be easily dislodged from the aforesaid shank. Also, the purpose for the aforesaid flat vertically shaped hook 40 is to present an edge which will restrict side motion of said hook and prevent roll-out if a door is forced. At the base of said semi-circular parallel lines 39, a horizontal thumb tab 42 is provided to facilitate removal of said hook from the secured position. The said tab consist of two horizontal lines 43, spaced apart and semi-circularly closed vertically at each end 44 of said parallel lines to form said tab. Another mode of anchoring the loop cinch 15 to the knob shank is provided and this mode may be more advantages for manufacture than the above hook mode wherein, a circular and open tab combination device 45 is utilized in conjunction with a circular elastic loop 46 in that, the said device consist of an outer semi-circular ring 47 which is circularly spaced apart inwardly by a smaller circular aperture 48 thereat, forming the opening that will house the solid circular cinch shaft 27 and extending outwardly from said semi-circular ring, attached, two extended horizontal parallel lines 49, spaced apart and vertically closed 50 at the ends of said parallel lines to form three sides of a vertical rectangularly shaped end tab connected to a semi-circular ring 47 thereat, the basic shape of said combination device 45 is formed and inwardly of said tab and spaced apart inwardly from said three sides, a rectangularly shaped aperture 51 consisting of two extended vertical lines, spaced apart and horizontally closed at each end to form the aforesaid shaped aperture 51 which is designed to house and hold the circular elastic loop 46 which consist of two circular lines 52 which are spaced apart circularly to form one continuous loop 53 that is folded together and threaded through the rectangularly shaped aperture 51 of said device and in the manner shown in the illustration 54 and pulled tight to form an open end loop for engagement with said door knob shank. In order of assembly, the cinch shaft 27 through the aperture 36 or 48, said shaft placed through the aperture 33 of the cinch plate 28 thereat, bradded 26 and the shape of the loop cinch 15 formed in a stamp press mode.

Figure 4:
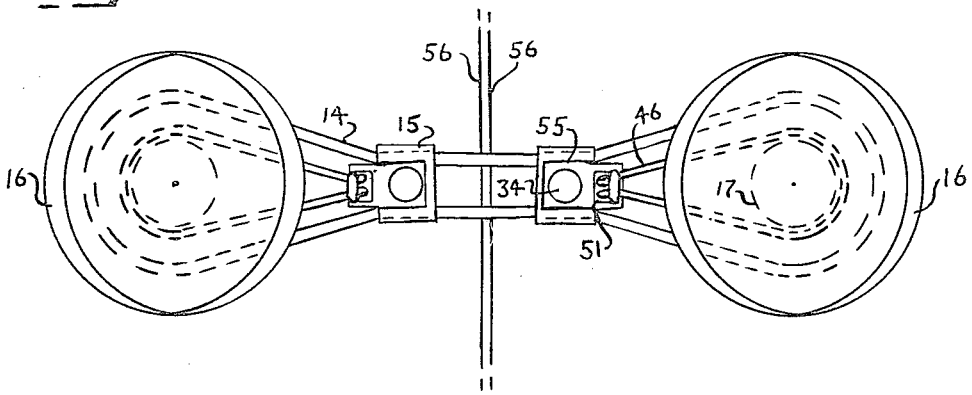

FIG. 4. The primary loop principle is used in the dual interior door knob 16 security cinch loop however, the trim anchor plate 1 of FIG. 1, is not used in this adaptation of dual knobs. This mode extends the length of the primary loop 14 to suite the distance between said door knobs and that the material and construction of said loop is the same as outlined in figure one and two above to form the primary loop 14. Dual loop cinchs 15 are used in this mode and in the same manner and construction as outlined in figure three however, the combination device 45 is utilized with the exception, where an outer ring 35 semi-circularly in shape was previously used, a rectangular shaped anchor bar 55 is used which has two extended parallel lines, spaced apart horizontally and vertically closed between and at the ends of said parallel lines and within said anchor bar 55 the circular aperture 48 and the rectangular aperture 51 of FIG. 3, to include the circular elastic loop 46 of the same figure and material construction and use stated above. Reference points for the leading vertical edge 56 in relation to the dual door knobs 16 and the same reference points for the leading door vertical edge 56 of FIG. 1, in relation to the single door knob 16 and the door-way trim 57 also, it was indicated in the summary that the trim 57 could be reinforced, if desired by the occupant, i.e., behind most door-way trim there is a vertical 2×4 or 2×6 board 58 and it is recommended that the occupant predrill apertures into the aforesaid trim, to prevent splitting of said trim, above and below the trim anchor plate 1 of FIG. 1, then drive nails of the same size as the drill into the predrilled apertures.

It is contemplated to make slight changes in the cinch anchor in conjunction with the elastic loop which will not substantially depart from the principles and scope of the invention.

The foregoing is considered as illustrative and basic only of the principles of the invention. Further, since numerous modifications and changes will readily be apparent to those skilled in the art, it is not desired to limit the invention to the precise construction and operation shown and described, and accordingly all suitable modifications and equivalents may be resorted to, falling within the scope of the invention.

What I claim is:

1. A door knob security cinch loop comprising an elongated member which forms a loop shaped to extend over a knob and being secured at a point spaced therefrom to a connection and pivot means; an elongated hook pivotally secured to said pivot means and shaped to fit about a shank of said knob; an opposite end of said security cinch loop comprising anchor means; including a part of said elongated member, and including means shaped for securing said opposite end to a structure adjacent said door.

2. The structure of claim 1, wherein said means shaped for securing said opposite end comprises an anchor plate secured to said part of said elongated member and shaped to form a hook having a chisel edge to fit behind an adjacent structure such as a door trim.

3. The structure of claim 1, wherein said means shaped for securing said opposite end is formed by said part of said elongated member shaped to fit over a second door knob to hold two adjacent doors closed.

* * * * *